US007409816B2

(12) United States Patent
Susai et al.

(10) Patent No.: US 7,409,816 B2
(45) Date of Patent: Aug. 12, 2008

(54) CONCENTRIC STRANDED CONDUCTOR

(75) Inventors: Kyota Susai, Tokyo (JP); Masanobu Hirai, Tokyo (JP); Kazuo Yoshida, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/790,691

(22) Filed: Apr. 26, 2007

(65) Prior Publication Data

US 2007/0251204 A1 Nov. 1, 2007

Related U.S. Application Data

(63) Continuation of application No. PCT/JP05/20158, filed on Oct. 27, 2005.

(30) Foreign Application Priority Data

Oct. 27, 2004 (JP) ..... 2004-312575
Sep. 30, 2005 (JP) ..... 2005-288978

(51) Int. Cl.
*D07B 1/00* (2006.01)

(52) U.S. Cl. ..... 57/231; 57/237

(58) Field of Classification Search ..... 57/213–215, 57/218, 219, 231
See application file for complete search history.

(56) References Cited

U.S. PATENT DOCUMENTS 3,823,542 A * 7/1974 Pemberton ..... 57/15
5,449,861 A * 9/1995 Fujino et al. ..... 174/113 A
5,711,143 A * 1/1998 Munakata et al. ..... 57/215
6,260,343 B1 * 7/2001 Pourladian ..... 57/200
6,339,920 B1 * 1/2002 Yokoyama ..... 57/210

FOREIGN PATENT DOCUMENTS

JP 10-321048 A 12/1998
JP 11-120839 A 4/1999
JP 2003-303515 A 10/2003

OTHER PUBLICATIONS

International Search Report of PCT/JP2005/020158, date of mailing Jan. 10, 2006.
Concise explanation of document JP-A-2003-303515.

* cited by examiner

*Primary Examiner*—Shaun R Hurley
(74) *Attorney, Agent, or Firm*—Westerman, Hattori, Daniels & Adrian, LLP.

(57) ABSTRACT

A concentric stranded conductor having a concentric strand having multiple strands. Each strand has multiple single wires. The concentric stranded conductor has a central core strand (5) and a first concentric strand layer (11) having multiple first-layer strands (9) twisted around the central core strand. The twist pitch of the central core strand is from 8 to 70 times the distance between diametrically opposed outer wires of the central core strand, the twist pitch of the first concentric strand layer is from 8 to 30 times the distance between diametrically opposed strands of the first concentric strand layer. $|\alpha-(\beta+\gamma)|$ is 15 degrees or less, where $\alpha$ is the twist angle of the central core strand and $\beta$ and $\gamma$ are the twist angles of the first-layer strands and first concentric strand layer, and the single wires are made of an aluminum or aluminum alloy to have elongation of 2% or more.

4 Claims, 3 Drawing Sheets

CONCENTRIC STRANDED CONDUCTOR

TECHNICAL FIELD

This invention relates to a concentric strand excellent in flexibility, particularly to a concentric stranded conductor for electrical transmission which is excellent in flexibility and is used in automobiles and the like.

BACKGROUND ART

Copper has been the main material used for concentric stranded conductors (rope lay concentric conductors) for electrical transmission used in automobiles and the like. In recent years, automobiles and the like are required to be lightweight in view of considerations such as energy-saving and, environmental preservation. Therefore, weight reduction of the concentric stranded conductor for electrical transmission is desirable. As a method for reducing weight, it has been proposed to use aluminum, which has small specific gravity, in place of copper.

An example is a concentric stranded conductor for electrical transmission that is excellent in bending resistance and vibration resistance and is resistant to breakage by friction and wearing at the time of bending and vibration (for example, see JP-A-2003-303515 ("JP-A" means unexamined published Japanese patent application)).

FIG. 2(*a*) is a partially cut-away perspective view showing the concentric stranded conductor for electrical transmission described in JP-A-2003-303515. FIG. 2(*b*) is a schematic cross section of the concentric stranded conductor. The concentric stranded conductor (1) for electrical transmission described in JP-A-2003-303515 is a concentric strand formed by twisting a plurality of single wires (3), (7), or (13) into child strands (i.e. a wire structure consisting of bunched or concentric configurations) and then twisting a plurality of the child strands. The concentric stranded conductor comprises a child strand at the center (central core strand (5) (a "strand" consists of any number of wires twisted together in the same direction with wires having the same lay length being located randomly)), a first concentric strand layer (11) formed around the child strand by twisting first-layer strands (9) so that the twist direction of their child strands (i.e. the twist direction of the single wires forming each child strand) is the same as the twist direction of parent strand (herein, a "parent strand" or "rope strand" is a final bunched or concentric configuration constituted by child strands, and "twist direction of parent strand" means the twist direction of the child strands forming the parent strand), and at least one concentric strand layer (17) formed around the first concentric strand by twisting second-layer strands (15) so that parent twist directions of adjoining layers are in the opposite direction and so that the twist direction of the child strands of each layer is the same as the twist direction of the parent strands.

Automobiles equipped with large capacity batteries, such as electric cars and hybrid cars, have appeared in recent years. Aluminum concentric stranded wires are also used in such vehicles as conductors for transmission of electricity from the battery. Since the amount of electricity conducted is large in these automobiles, a concentric stranded wire having a larger diameter than conventional ones is used. However, this raises the concern that the larger diameter may make attachment of the concentric stranded wire to the body of the automobile difficult. In addition, wires are required to be installed in a limited space. A concentric stranded conductor with better flexibility is therefore desired.

DISCLOSURE OF INVENTION

The object of the invention is to solve the above-mentioned problems and to provide a concentric stranded conductor excellent in flexibility.

In order to solve the above-mentioned problems, the invention in a first aspect provides a concentric stranded conductor having a concentric strand comprising a plurality of strands twisted together, in which each of the strands comprises a plurality of single wires twisted together; wherein the concentric stranded conductor has a central core strand (5) and a first concentric strand layer (11) which comprises a plurality of first-layer strands (9) twisted together around the central core strand (5); wherein a twist pitch of the central core strand (5) is from 8 to 70 times a distance between diametrically opposed outer wires of the central core strand (5), a twist pitch of the first concentric strand layer (11) is from 8 to 30 times a distance between diametrically opposed strands of the first concentric strand layer (11), $|\alpha-(\beta+\gamma)|$ is 15 degrees or less, where $\alpha$ is a twist angle of the central core strand (5), $\beta$ is a twist angle of the first-layer strands (9) and $\gamma$ is a twist angle of the first concentric strand layer (11), and each of the single wires is made of aluminum or an aluminum alloy, each having elongation of 2% or more.

The invention in a second aspect provides a concentric stranded conductor according to the first embodiment, wherein the central core strand (5), the first-layer strands (9), and the first concentric strand layer (11) are all twisted in the same direction.

The invention in a third aspect provides a method for producing a concentric stranded conductor (1) comprising the steps of: twisting, around a central core strand (5), a first concentric strand layer (11) in the same direction as the twist direction of the central core strand (5), the first concentric strand layer (11) comprising first-layer strands (9) each twisted in the same direction as the twist direction of the central core strand (5); and twisting, around the first concentric strand layer (11), a second concentric strand layer (17) in the same direction as the twist direction of the central core strand (5), the second concentric strand layer (17) comprising second-layer strands (15) each twisted in the same direction as the twist direction of the central core strand (5); wherein the conductor uses single wires of aluminum or an aluminum alloy each having elongation of 2% or more; wherein a twist pitch of the central core strand (5) is from 30 to 70 times a distance between diametrically opposed outer wires of the central core strand (5); wherein a twist pitch of the second concentric strand layer (17) is from 10 to 30 times a distance between diametrically opposed strands of the second concentric strand layer (17); and wherein the twist pitch of the first concentric strand layer (11) is the same as or larger than the twist pitch of the second concentric strand layer (17) and a difference between the twist pitches is 20 times or lower.

The invention in a fourth aspect provides a method for producing a concentric stranded conductor, wherein, in the method for producing a concentric stranded conductor according to the third embodiment, multiple layers of concentric strands, each of which comprises strands twisted together in the same direction as the twist direction of the central core strand (5), are twisted in the same direction as the twist direction of the central core strand (5) around the second concentric strand layer (17).

The invention in a fifth aspect provides a concentric stranded conductor having a second concentric strand layer (17) comprising a plurality of second-layer strands (15) twisted together around the concentric stranded conductor according to the first or second embodiment, wherein $|\alpha-(\delta+$ $\epsilon)|$ is 15 degrees or less, where $\alpha$ is the twist angle of the central core strand (5), $\delta$ is a twist angle of the second-layer strands (15) and $\epsilon$ is a twist angle of the second concentric strand layer (17); wherein $|(\beta+\gamma)-(\delta+\epsilon)|$ is 15 degrees or less, where $\beta$ is the twist angle of the first-layer strands (9), $\gamma$ is the twist angle of the first concentric strand layer (11), $\delta$ is the twist angle of the second-layer strands (15) and $\epsilon$ is the twist angle of the second concentric strand layer (17); and wherein a twist pitch of the second concentric strand layer (17) is from 8 to 30 times a distance between diametrically opposed strands of the second concentric strand layer (17).

The invention in a sixth aspect provides a concentric stranded conductor wherein, in the concentric stranded conductor according to the fifth embodiment, the central core strand (5), the first-layer strands (9), the first concentric strand layer (11), the second-layer strands (15), and the second concentric strand layer (17) are all twisted in the same direction.

The "distance between diametrically opposed strands" as termed with respect to the present invention means a diameter obtained by subtracting an outer diameter of one single wire from an outer diameter of a stranded wire.

A proportion of surface contact between single wires is enhanced in the invention. Accordingly, since concentrated contact portions between the layers as in the prior art are dispersed in the invention, local nicking decreases and flexibility is improved due to good slidability between single wires. Since the entire single wires are aligned in the same twist direction by twisting all of strands and concentric strands in the concentric stranded conductor, the single wires are brought into surface contact and flexibility is further improved.

Other and further features and advantages of the invention will appear more fully from the following description, appropriately referring to the accompanying drawings.

BEST MODE FOR CARRYING OUT THE INVENTION

Figure 1A:
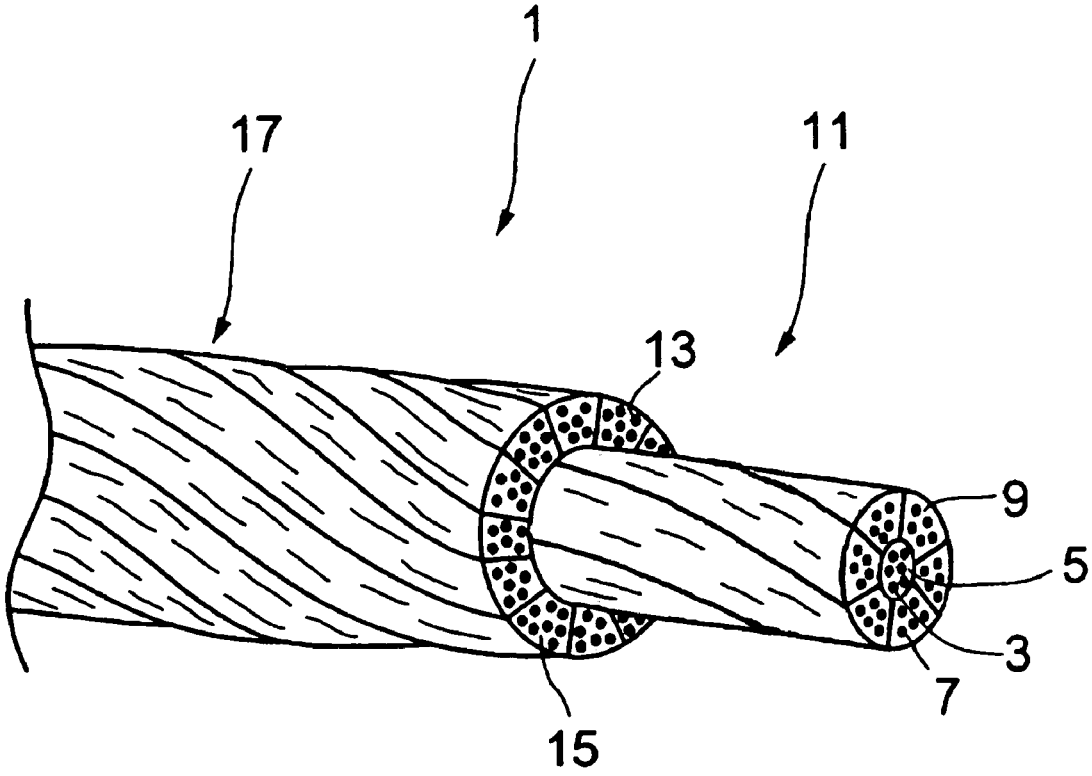
FIG. 1(*a*) is a schematic partial perspective view of a preferred embodiment of this invention and FIG. 1(*b*) is a cross-sectional view thereof.

Preferred embodiments of the invention will be described below.

The concentric stranded conductor (1) of the invention comprises a concentric strand formed by twisting sets of single wires into strands and then twisting together a plurality of such strands. Particularly, it is preferable that the concentric stranded conductor (1) comprise multiple layers wherein the twist directions of the central core strand (5), the first-layer strands (9), the first concentric strand layer (11), the second-layer strands (15), and the second concentric strand layer (17) are all the same, i.e., the twist directions of the strands of each layer ("twist direction of strand" means the twist direction of the single wires forming the strand) and the twist directions of the concentric strands of each layer ("twist direction of concentric strand" means the twist direction of the strands forming the concentric strand) are all the same.

Figure 1B:
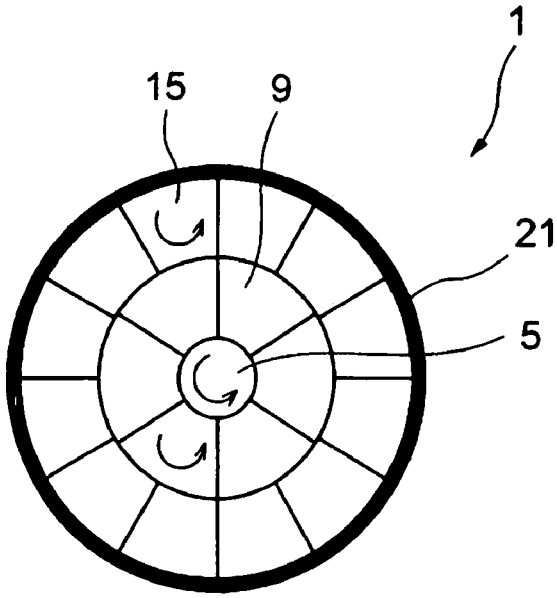
Figure 2A:
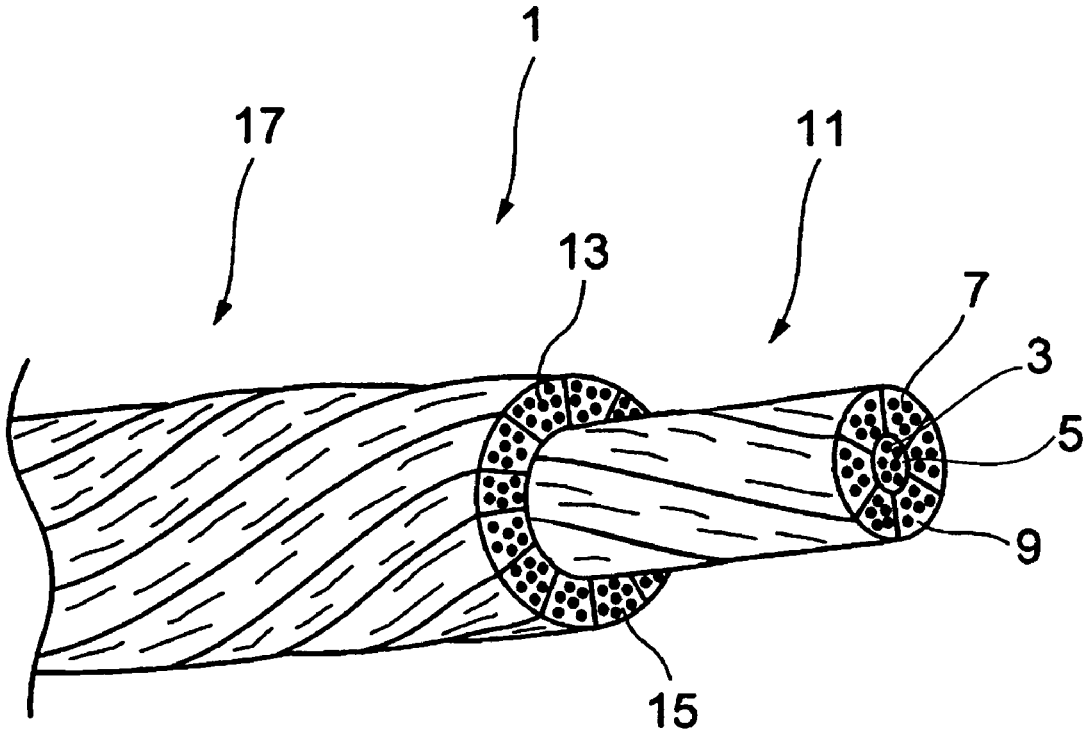
Fig. 2(a) Prior Art
FIG. 2(*a*) is a schematic partial perspective view of a prior art conductor and FIG. 2(*b*) is a cross-sectional view thereof.
Figure 2B:
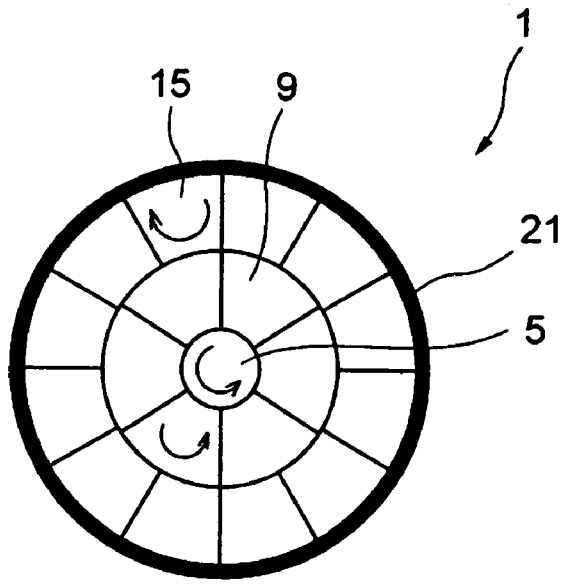
Fig. 2(b) Prior Art

FIG. 1(*a*) is a partially cut-away perspective view showing the concentric stranded conductor (1).

FIG. 1(*b*) is a schematic cross section of the concentric stranded conductor (1). The arrows in FIG. 1(*b*) show the twist directions of the single wires (3), (7), and (13) explained below. In the concentric stranded conductor (1), a central core strand (5) formed by twisting single wires (3) together, counterclockwise, for example, is disposed at the center, and six first-layer strands (9) each formed by twisting single wires (7) together counterclockwise are twisted counterclockwise to form the first concentric strand layer (11).

Then, twelve of second-layer strands (15) each formed by twisting together single wires (13) counterclockwise are twisted counterclockwise around the first concentric strand layer (11) to form the second concentric strand layer (17). The second concentric strand layer (17) is coated with an insulator coating (21) so as to contact the surface closely.

For improving the flexibility of the conductor, the twist direction of the central core strand (5) is preferably the same as the twist direction of the first concentric strand layer (11) provided around the central core strand (5).

The first concentric strand layer (11) is preferably twisted in the same twist direction as the first-layer strands (9). Twisting the first concentric strand layer (11) and the first-layer strands (9) in the same direction is preferable because it brings the single wires (7) in the first-layer strands (9) into surface contact with one another and deforms the cross sectional shape of the strands of the first concentric strand layer (11). In other words, the twisting deforms the cross-sectional shape of the first-layer strands (9) into a trapezoid-like shape (i.e., a shape obtained by subtracting a sector having an angle of 180° or less from a larger similar sector), thus bringing the adjoining first-layer strands (9) into close contact and reducing gaps.

The second concentric strand layer (17) is preferably twisted in the same direction as the second-layer strands (15). Twisting the second concentric strand layer (17) and the second-layer strands (15) in the same twist direction is preferable because it brings the single wires (13) of the second-layer strands (15) into surface contact with one another and deforms the cross-sectional shape of the second-layer strands (15).

As shown in FIG. 1(*b*), the twisting deforms the cross-sectional shape of the second-layer strands (15) into a trapezoid-like shape, thus bringing the adjoining second-layer strands (15) into close contact and reducing gaps.

In order to improve flexibility of the conductor, the twist pitch of the central core strand (5) is defined as from 8 to 70 times the distance between diametrically opposed outer wires of the central core strand (5), and more preferably from 10 to 30 times said distance.

In order to improve flexibility of the conductor, the twist pitch of the first concentric strand layer (11) is defined as from 8 to 30 times the distance between diametrically opposed strands of the first concentric strand layer (11), and more preferably from 10 to 20 times said distance.

In order to improve flexibility of the conductor, the twist pitch of the second concentric strand layer (17) is preferably 8 to 30 times the distance between diametrically opposed strands of the second concentric strand layer (17). The twist pitch is more preferably from 10 to 20 times. The twist pitch (see FIG. 1) can be determined, for example, with reference to Japanese Industrial Standard JIS G3525.

In order to improve flexibility, $|\alpha-(\beta+\gamma)|$ is defined as from 15 degrees or less to 0 degree or more, more preferably from 10 degrees or less to 0 degree or more, where $\alpha$ is the twist angle of the central core strand (5), $\beta$ is the twist angle of the first-layer strands (9) and $\gamma$ is the twist angle of the first concentric strand layer (11). In order to improve flexibility, it is also preferable for $|\alpha-(\delta+\epsilon)|$ to be from 15 degrees or less to 0 degree or more, more preferably from 10 degrees or less to 0 degree or more, where $\alpha$ is the twist angle of the central core strand (5), $\delta$ is the twist angle of the second-layer strands (15) and $\epsilon$ is the twist angle of the second concentric strand layer (17). In addition, for improving flexibility, $|(\beta+\gamma)-(\delta+\epsilon)|$ is preferably from 15 degrees or less to 0 degree or more, more preferably from 10 degrees or less to 0 degree or more, where $\beta$ is the twist angle of the first-layer strands (9), $\gamma$ is the twist angle of the first concentric strand layer (11), $\delta$ is the twist angle of the second-layer strands (15) and $\epsilon$ is the twist angle of the second concentric strand layer (17). The twist angle is an angle in the longitudinal direction of strands or concentric strands.

By forming a concentric stranded conductor (1) as shown in FIG. 1(*b*), it is possible to reduce roughness of the outer circumference of the concentric stranded conductor (1). That is, while the insulator coating (21) used for conventional concentric stranded conductors may be provided on the concentric stranded conductor (1) of the invention by a conventional method, the insulator coating (21) does not penetrate into the gaps between the second-layer strands (15). Therefore, the second-layer strands (15) do not tightly contact the insulator coating (21).

In the following, the invention is described in more detail, but only for purposes of illustration and not for limitation.

In the concentric stranded conductor (1), for example, the central core strand (5) formed by twisting thirteen aluminum single wires (3) with a diameter of 0.32 mm together in the counterclockwise direction is placed at the center, and six first-layer strands (9) each formed by twisting thirteen aluminum single wires (7) with a diameter of 0.32 mm together in the counterclockwise direction are twisted together in the counterclockwise direction to form the first concentric strand layer (11).

The twist direction of the first concentric strand layer (11) is preferably the same as the twist direction of the first-layer strands (9). Twisting in the same twist direction is preferable since the single wires (7) of the first-layer strands (9) are brought into surface contact with one another, causing the first-layer strands (9) to be twisted so that the cross-sectional shape of each strand is deformed. As shown in FIG. 1(*b*), the twisting deforms the cross-sectional shape of the first-layer strands (9) into a trapezoid-like shape, thus bringing the adjoining first-layer strands (9) into close contact and reducing the gaps.

The central core strand (5) is preferably stranded in the same twist direction for improving flexibility. The stranding in the same twist direction may be conducted using a bunch strander. The first concentric strand layer (11) and the second concentric strand layer (17) may be twisted using a planetary strander (with back-twist functionality) or rigid strander (without back-twist functionality).

A second concentric strand layer (17) is preferably disposed around the first concentric strand layer (11). Such a second concentric strand layer (17) is formed by stranding clockwise twelve second-layer strands (15) each formed of thirteen single wires (13) twisted together counterclockwise.

Twisting the second concentric strand layer (17) and the second-layer strands (15) in the same twist direction is preferable, since the single wires (13) of the second-layer strands (15) are brought into surface contact with one another, and the second-layer strands (15) are twisted so that the cross sectional shape of each strand is deformed.

Compared with conventional structures, concentric strands having strands with a deformed cross sectional shape can achieve smaller outer diameter and also reduce the outer diameter of the coating. Further, since the surface roughness is reduced, the ratio of the thickness of a thick part to the thickness of a thin part of the insulator coating (21) (roughness of the inner surface of the insulator coating) can be reduced, and this enables the amount of the coating material to be reduced.

According to the invention, because the roughness of the outer circumference of the concentric stranded conductor (1) is reduced, the insulator coating (21) scarcely penetrates into the gaps around the second concentric strand layer (17). Accordingly, concentration of adhesive force can be relaxed since the adhesive force between the insulator coating (21) and the concentric stranded conductor (1) is shared by the whole concentric stranded conductor (1). Consequently, the conductor becomes easy to bend (good flexibility) and slidability is improved, resulting in improvement of bending resistance and wear resistance.

According to the invention, the single wires (7) and single wires (13) are brought into surface contact with one another. Consequently, local nicking is reduced since concentrated contact parts among the layers are dispersed, resulting in improvement of bendability and slidability as well as improvement of bending resistance and wear resistance.

According to the invention, since crossover between single wires is reduced inside a terminal, nicking of single wires is reduced and therefore strength deterioration of the electrical wire at the time of solderless connection or weld connection is reduced.

The invention is by no means restricted to the embodiments set out herein, and may be implemented in various embodiments falling within the gist of the invention. For example, while the twist direction is counterclockwise in the above-mentioned embodiments, the twist direction may be clockwise.

The conductor of the invention is preferably formed by coating the concentric stranded conductor (1), which comprises single wires (3), (7), and (13) of aluminum or aluminum alloy, with the insulator coating (21). The single wires (3), (7), and (13) preferably have elongation of 2% or more because this improves flexibility. The elongation is more preferably 5% or more and is further preferably 15% or more. The aluminum or aluminum alloy used can be of any type insofar as it can be processed into the single wires (3), (7), and (13), and the aluminum alloy is not particularly restricted by its alloy components.

In the following, preferable embodiments when preparing the concentric stranded conductors of the invention as concentric stranded conductors for electrical transmission in automobiles and the like will be described.

While the diameter of the single wire is not particularly restricted, it is usually from 0.16 mm to 1.0 mm, preferably about 0.3 mm. While the number of the single wires constituting the central core strand is not particularly restricted, it is usually from 7 to 80 single wires, preferably from 10 to 30 single wires. While the number of the single wires constituting the strands in the n-th layer (n is an integer of 1 or more) is not particularly restricted, it is usually from 7 to 80 single wires, preferably from 10 to 30 single wires. While the number of the strands constituting the n-th layer concentric strand (n is an integer of 1 or more) is not particularly restricted, it is usually from 6 to 80 strands, preferably from 7 to 80 strands, and more preferably from 10 to 30 strands. While the number of concentric strand layers is not particularly restricted, it is usually from 1 to 3 layers, more preferably from 2 to 3 layers.

As the insulator coating, any of those generally used for conventional concentric stranded conductors may be used, and it is preferably a polyethylene resin or a Noryl (registered trademark) resin. In the following, the present invention will be described in more detail based on examples, but the invention is not meant to be limited by these.

EXAMPLES

As the examples of the invention, concentric stranded conductors were produced by the following procedures, using a strander. Firstly, a central core strand (5) formed by twisting thirteen aluminum single wires (3) with a diameter of 0.32 mm together in the counterclockwise direction was placed at the center, and six first-layer strands (9) each formed by twisting thirteen aluminum single wires (7) with a diameter of 0.32 mm together in the counterclockwise direction were twisted counterclockwise to form a first concentric strand layer (11). In Examples 16 to 24, these were used as concentric stranded conductors, without further modification.

In Examples 1 to 15, the second-layer strands (15) were formed by twisting thirteen aluminum single wires (13) together, and the second concentric strand layer (17) was formed by twisting twelve second-layer strands (15) counterclockwise around the first concentric strand layer (11). For the purpose of comparison, Comparative Examples 1 to 22 were prepared with appropriate changes in the kind of the strand, the twist angle, and the twist pitch.

Figure 3:
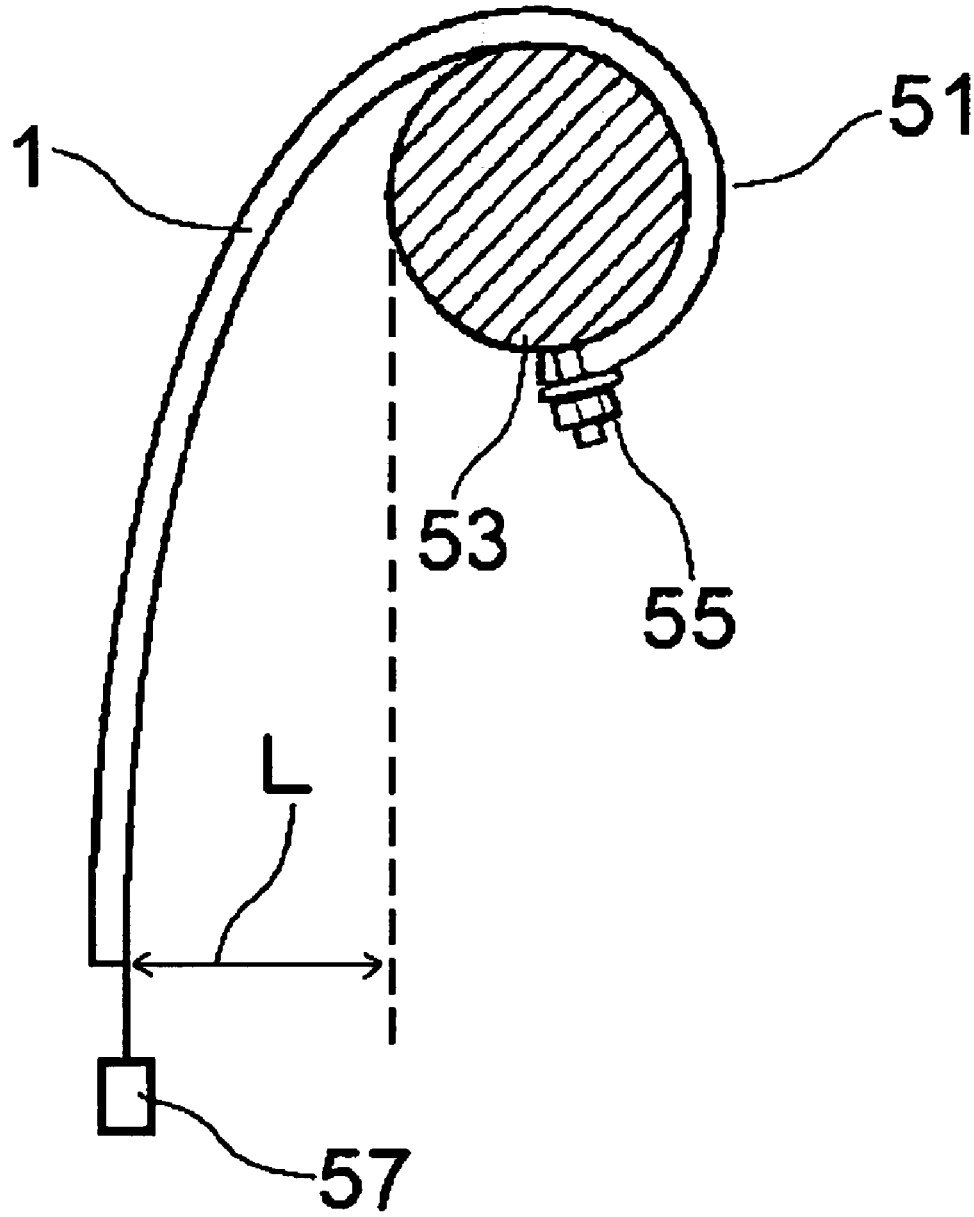
FIG. 3 is a side view of a flexibility tester used in the Examples.

The prepared concentric stranded conductors (1) were evaluated using a flexibility tester (51) as shown in FIG. 3. Five concentric stranded conductors (1) with a length of 150 mm and a cross-sectional area of 20 $mm^2$ were prepared for each example and comparative example. A 160 g weight (57) was attached to one end of each concentric stranded conductor (1), and the other end of the concentric stranded conductor (1) was fixed on a mandrel (53) with a diameter of 90 mm, using a conductor fixing fitting (55). The horizontal distance between one end (the end to which the weight (57) was attached) of the concentric stranded conductor (1) and mandrel 53 was measured as an amount of displacement, L, and it was judged that a smaller amount of displacement L indicated better flexibility (concentric stranded conductors which had an amount of displacement of 30 mm or less were judged to have satisfactory flexibility). The test was repeated for each of the five concentric stranded conductors (1) of each example, and the results were compared among the examples and comparative examples using the average value of the amount of displacement. Examples 16 to 24 and Comparative Examples 18 to 22 were tested using the same measuring conditions as described above, except that the amount of displacement was measured using a 60-g weight in place of the 160-g weight. The results of comparison are shown in Tables 1 and 2. In the following, "Twist pitch magnification" in Tables 1 and 2 is represented by a ratio of "pitch (mm)/distance between diametrically opposed strands)" (i.e. twisting pitch in length divided by strand diameter).

TABLE 1

| | Single wire | Central core strand | | | First-layer strands | | | First concentric strand layer | | |
|---|---|---|---|---|---|---|---|---|---|---|
| | elongation (%) | Twist angle | Pitch (mm) | Twist pitch magnification | Twist angle | Pitch (mm) | Twist pitch magnification | Twist angle | Pitch (mm) | Twist pitch magnification |
| Example | | | | | | | | | | |
| 1 | 5 | 4.1 | 43.4 | 33.0 | 4.1 | 43.4 | 33.0 | 8.9 | 52.6 | 20.0 |
| 2 | 5 | 2.0 | 89.4 | 68.0 | 2.0 | 89.4 | 68.0 | 8.9 | 52.6 | 20.0 |
| 3 | 5 | 2.7 | 65.8 | 50.0 | 2.7 | 65.8 | 50.0 | 6.0 | 78.9 | 30.0 |
| 4 | 5 | 2.7 | 65.8 | 50.0 | 2.7 | 65.8 | 50.0 | 6.0 | 78.9 | 30.0 |
| 5 | 12 | 2.7 | 65.8 | 50.0 | 2.7 | 65.8 | 50.0 | 6.0 | 78.9 | 30.0 |
| 6 | 17 | 2.7 | 65.8 | 50.0 | 1.9 | 92.1 | 70.0 | 6.0 | 78.9 | 30.0 |
| 7 | 2 | 2.7 | 65.8 | 50.0 | 4.5 | 39.5 | 30.0 | 6.0 | 78.9 | 30.0 |
| 8 | 2 | 4.1 | 43.4 | 33.0 | 4.1 | 43.4 | 33.0 | 8.9 | 52.6 | 20.0 |
| 9 | 2 | 2.0 | 89.4 | 68.0 | 2.0 | 89.4 | 68.0 | 8.9 | 52.6 | 20.0 |
| 10 | 2 | 2.0 | 89.4 | 68.0 | −4.9 | −36.8 | 28.0 | 6.0 | 78.9 | 30.0 |
| 11 | 2 | 4.9 | 36.8 | 28.0 | 4.9 | 36.8 | 28.0 | 8.9 | 52.6 | 20.0 |
| 12 | 2 | 4.9 | 36.8 | 28.0 | −4.9 | −36.8 | 28.0 | 17.4 | 26.3 | 10.0 |
| 13 | 2 | 4.9 | 36.8 | 28.0 | 4.9 | 36.8 | 28.0 | 8.9 | 52.6 | 20.0 |
| 14 | 2 | 4.9 | 36.8 | 28.0 | 13.4 | 13.2 | 10.0 | −8.9 | −52.6 | 20.0 |
| 15 | 2 | 6.8 | 26.3 | 20.0 | 4.9 | 36.8 | 28.0 | −8.9 | −52.6 | 20.0 |
| Comparative example | | | | | | | | | | |
| 1 | 5 | 4.1 | 43.4 | 33.0 | 4.1 | 43.4 | 33.0 | 8.9 | 52.6 | 20.0 |
| 2 | 5 | 1.8 | 98.6 | 75.0 | 1.8 | 98.6 | 75.0 | 8.9 | 52.6 | 20.0 |
| 3 | 5 | 2.7 | 65.8 | 50.0 | 2.7 | 65.8 | 50.0 | 5.1 | 92.1 | 35.0 |
| 4 | 5 | 2.7 | 65.8 | 50.0 | −4.5 | −39.5 | 30.0 | 3.7 | 128.9 | 49.0 |
| 5 | 5 | −4.9 | −36.8 | 28.0 | −4.9 | −36.8 | 28.0 | 6.0 | 78.9 | 30.0 |
| 6 | 5 | 2.7 | 65.8 | 50.0 | 16.5 | 10.5 | 8.0 | 9.4 | 50.0 | 19.0 |
| 7 | 1.5 | 2.7 | 65.8 | 50.0 | 2.7 | 65.8 | 50.0 | 6.0 | 78.9 | 30.0 |
| 8 | 5 | −2.7 | −65.8 | 50.0 | 6.8 | 26.3 | 20.0 | 6.0 | 78.9 | 30.0 |
| 9 | 5 | 2.7 | 65.8 | 50.0 | −6.8 | −26.3 | 20.0 | −6.0 | −78.9 | 30.0 |
| 10 | 5 | 2.7 | 65.8 | 50.0 | 6.8 | 26.3 | 20.0 | −6.0 | −78.9 | 30.0 |
| 11 | 5 | −2.7 | −65.8 | 50.0 | −2.7 | −65.8 | 50.0 | −6.0 | −78.9 | 30.0 |
| 12 | 1.5 | 4.9 | 36.8 | 28.0 | 4.9 | 36.8 | 28.0 | 8.9 | 52.6 | 20.0 |
| 13 | 1.5 | 6.8 | 26.3 | 20.0 | 4.9 | 36.8 | 28.0 | −8.9 | −52.6 | 20.0 |
| 14 | 2 | 17.6 | 9.9 | 7.5 | 17.6 | 9.9 | 7.5 | 9.4 | 50.0 | 19.0 |
| 15 | 5 | 13.4 | 13.2 | 10.0 | 1.9 | 92.1 | 70.0 | 22.7 | 19.7 | 7.5 |
| 16 | 5 | 4.9 | 36.8 | 28.0 | 4.9 | 36.8 | 28.0 | 9.4 | 50.0 | 19.0 |
| 17 | 5 | 4.9 | 36.8 | 28.0 | 4.9 | 36.8 | 28.0 | 9.4 | 50.0 | 19.0 |

TABLE 1-continued

| | Second-layer strands | | | Second concentric strand layer | | |
|---|---|---|---|---|---|---|
| | Twist angle | Pitch (mm) | Twist pitch magnification | Twist angle | Pitch (mm) | Twist pitch magnification |
| Example | | | | | | |
| 1 | 4.1 | 43.4 | 33.0 | 14.7 | 63.1 | 12.0 |
| 2 | 2.0 | 89.4 | 68.0 | 14.7 | 63.1 | 12.0 |
| 3 | −2.3 | −78.9 | 60.0 | 14.7 | 63.1 | 12.0 |
| 4 | 6.8 | 26.3 | 20.0 | 6.2 | 152.6 | 29.0 |
| 5 | 2.7 | 65.8 | 50.0 | 8.9 | 105.2 | 20.0 |
| 6 | −1.9 | −92.1 | 70.0 | 8.9 | 105.2 | 20.0 |
| 7 | 4.5 | 39.5 | 30.0 | 8.9 | 105.2 | 20.0 |
| 8 | −4.1 | −43.4 | 33.0 | 14.7 | 63.1 | 12.0 |
| 9 | 2.0 | 89.4 | 68.0 | 14.7 | 63.1 | 12.0 |
| 10 | 4.9 | 36.8 | 28.0 | 6.2 | 152.6 | 29.0 |
| 11 | 4.9 | 36.8 | 28.0 | −6.0 | −157.8 | 30.0 |
| 12 | 4.9 | 36.8 | 28.0 | 6.0 | 157.8 | 30.0 |
| 13 | 4.9 | 36.8 | 28.0 | 6.0 | 157.8 | 30.0 |
| 14 | 4.9 | 36.8 | 28.0 | 6.0 | 157.8 | 30.0 |
| 15 | 4.9 | 36.8 | 28.0 | 6.0 | 157.8 | 30.0 |
| Comparative example | | | | | | |
| 1 | 4.1 | 43.4 | 33.0 | 19.2 | 47.4 | 9.0 |
| 2 | 1.8 | 98.6 | 75.0 | 14.7 | 63.1 | 12.0 |
| 3 | 2.7 | 65.8 | 50.0 | 14.7 | 63.1 | 12.0 |
| 4 | 4.5 | 39.5 | 30.0 | 5.6 | 168.4 | 32.0 |
| 5 | 4.9 | 36.8 | 28.0 | 8.9 | 105.2 | 20.0 |
| 6 | 2.7 | 65.8 | 50.0 | 8.9 | 105.2 | 20.0 |
| 7 | 16.5 | 10.5 | 8.0 | 8.9 | 105.2 | 20.0 |
| 8 | 6.8 | 26.3 | 20.0 | 8.9 | 105.2 | 20.0 |
| 9 | −6.8 | −26.3 | 20.0 | 8.9 | 105.2 | 20.0 |
| 10 | −4.5 | −39.5 | 30.0 | −8.9 | −105.2 | 20.0 |
| 11 | 4.5 | 39.5 | 30.0 | 8.9 | 105.2 | 20.0 |
| 12 | 4.9 | 36.8 | 28.0 | −6.0 | −157.8 | 30.0 |
| 13 | 4.9 | 36.8 | 28.0 | 6.0 | 157.8 | 30.0 |
| 14 | 17.6 | 9.9 | 7.5 | 6.0 | 157.8 | 30.0 |
| 15 | 4.5 | 39.5 | 30.0 | 6.0 | 157.8 | 30.0 |
| 16 | 4.9 | 36.8 | 28.0 | 22.7 | 39.5 | 7.5 |
| 17 | −4.9 | −36.8 | 28.0 | 5.6 | 168.4 | 32.0 |

| | Difference of the twist angle | | | Amount of |
|---|---|---|---|---|
| | ※1 (First layer and center) | ※2 (Second layer and center) | ※3 (First layer and second layer) | displacement (mm) |
| Example | | | | |
| 1 | 8.9 | 14.7 | 5.7 | 22 |
| 2 | 8.9 | 14.7 | 5.7 | 28 |
| 3 | 6.0 | 9.7 | 3.7 | 20 |
| 4 | 6.0 | 10.2 | 4.3 | 26 |
| 5 | 6.0 | 8.9 | 2.9 | 13 |
| 6 | 5.2 | 4.3 | 0.9 | 9 |
| 7 | 7.8 | 10.7 | 2.9 | 22 |
| 8 | 8.9 | 6.4 | 2.5 | 20 |
| 9 | 8.9 | 14.7 | 5.7 | 26 |
| 10 | 0.9 | 9.0 | 9.9 | 24 |
| 11 | 8.9 | 6.0 | 14.9 | 30 |
| 12 | 7.7 | 6.0 | 1.8 | 15 |
| 13 | 8.9 | 6.0 | 2.9 | 22 |
| 14 | 0.4 | 6.0 | 6.4 | 18 |
| 15 | 10.9 | 4.1 | 14.9 | 30 |
| Comparative example | | | | |
| 1 | 8.9 | 19.2 | 10.3 | ★1 |
| 2 | 8.9 | 14.7 | 5.7 | 36 |
| 3 | 5.1 | 14.7 | 9.5 | 35 |
| 4 | 3.6 | 7.4 | 11.0 | 35 |
| 5 | 6.0 | 18.6 | 12.7 | ★1 |
| 6 | 23.2 | 8.9 | 14.3 | ★1 |
| 7 | 6.0 | 22.8 | 16.8 | 39 |
| 8 | 15.5 | 18.4 | 2.9 | 40 |
| 9 | 15.5 | 0.6 | 14.9 | 36 |
| 10 | 1.9 | 16.2 | 14.3 | 40 |

TABLE 1-continued

| | | | | |
|---|---|---|---|---|
| 11 | 6.0 | 16.2 | 22.2 | 35 |
| 12 | 8.9 | 6.0 | 14.9 | 32 |
| 13 | 10.9 | 4.1 | 14.9 | 33 |
| 14 | 9.4 | 6.0 | 3.4 | ★1 |
| 15 | 11.3 | 2.9 | 14.2 | 35 |
| 16 | 9.4 | 22.7 | 13.3 | 40 |
| 17 | 9.4 | 4.1 | 13.5 | 33 |

Note 1:
Counterclockwise twisting and clockwise twisting are designated by + and −, respectively.
★1: A conductor cannot be manufactured since concentric stranding was impossible.
※1: The value indicates $|\alpha - (\beta + \gamma)|$, where $\alpha$ is the twist angle of the central core strand (5), $\beta$ is the twist angle of the first-layer strands (9) and $\gamma$ is the twist angle of first concentric strand layer (11).
※2: The value indicates $|\alpha - (\delta + \epsilon)|$, where $\alpha$ is the twist angle of the central core strand (5), $\delta$ is the twist angle of the second-layer strands (15) and $\epsilon$ is the twist angle of second concentric strand layer (17).
※3: The value indicates $|(\beta + \gamma) - (\delta + \epsilon)|$, where $\beta$ is the twist angle of the first-layer strands (9), $\gamma$ is the twist angle of the first concentric strand layer (11), $\delta$ is the twist angle of second-layer strands (15) and $\epsilon$ is the twist angle of the second concentric strand layer (17).

TABLE 2

| | Single wire | Central core strand | | | First-layer strands | | | First concentric strand layer | | | Difference of the twist | Amount of |
|---|---|---|---|---|---|---|---|---|---|---|---|---|
| | elongation (%) | Twist angle | Pitch (mm) | Twist pitch magnification | Twist angle | Pitch (mm) | Twist pitch magnification | Twist angle | Pitch (mm) | Twist pitch magnification | angle ※1 | displacement (mm) |
| Example 16 | 2 | 4.9 | 36.8 | 28.0 | 4.9 | 36.8 | 28.0 | 9.4 | 50.0 | 19.0 | 9.4 | 16 |
| Example 17 | 2 | 16.5 | 10.5 | 8.0 | 4.9 | 36.8 | 28.0 | 9.4 | 50.0 | 19.0 | 2.3 | 10 |
| Example 18 | 2 | 2.1 | 85.5 | 65.0 | 4.9 | 36.8 | 28.0 | 9.4 | 50.0 | 19.0 | 12.1 | 19 |
| Example 19 | 2 | 4.9 | 36.8 | 28.0 | 4.9 | 36.8 | 28.0 | 6.4 | 73.7 | 28.0 | 6.4 | 16 |
| Example 20 | 2 | 9.0 | 19.7 | 15.0 | 1.9 | 92.1 | 70.0 | 21.4 | 21.0 | 8.0 | 14.4 | 20 |
| Example 21 | 2 | 4.9 | 36.8 | 28.0 | 4.9 | 36.8 | 28.0 | 7.2 | 65.8 | 25.0 | 7.2 | 15 |
| Example 22 | 2 | 4.9 | 36.8 | 28.0 | −4.9 | −36.8 | −28.0 | 9.4 | 50.0 | 19.0 | 0.3 | 10 |
| Example 23 | 2 | 4.9 | 36.8 | 28.0 | 4.9 | 36.8 | 28.0 | −9.4 | −50.0 | 19.0 | 9.4 | 17 |
| Example 24 | 2 | −2.1 | −85.5 | 65.0 | 4.9 | 36.8 | 28.0 | 6.4 | 73.7 | 28.0 | 13.3 | 20 |
| Comparative example 18 | 2 | 1.8 | 98.6 | 75.0 | 4.9 | 36.8 | 28.0 | 9.4 | 50.0 | 19.0 | 12.4 | ★1 |
| Comparative example 19 | 2 | 18.8 | 9.2 | 7.0 | 4.9 | 36.8 | 28.0 | 9.4 | 50.0 | 19.0 | 4.5 | ★1 |
| Comparative example 20 | 2 | 4.9 | 36.8 | 28.0 | 4.9 | 36.8 | 28.0 | 24.2 | 18.4 | 7.0 | 24.2 | 22 |
| Comparative example 21 | 2 | 4.9 | 36.8 | 28.0 | 4.9 | 36.8 | 28.0 | 5.6 | 84.2 | 32.0 | 5.6 | ★1 |
| Comparative example 22 | 2 | 9.0 | 19.7 | 15.0 | 4.9 | 36.8 | 28.0 | 21.4 | 21.0 | 8.0 | 17.3 | 21 |

Note 1:
Counterclockwise twisting and clockwise twisting are designated by + and −, respectively.
★1: It was impossible to manufacture a conductor, since concentric stranding was impossible.
※1: The value indicates $|\alpha - (\beta + \gamma)|$, where $\alpha$ is the twist angle of the central core strand (5), $\beta$ is the twist angle of the first-layer strands (9) and $\gamma$ is the twist angle of first concentric strand layer (11).

As is apparent from Tables 1 and 2, the examples according to the invention exhibited small amount of displacement and were excellent in flexibility.

On the contrary, in Comparative Example 1, concentric stranding was impossible since $|\alpha-(\beta+\gamma)|$ exceeded 15 degrees, where $\alpha$ is the twist angle of the central core strand (5), $\beta$ is the twist angle of the second-layer strands (15) and $\gamma$ is the twist angle of the second concentric strand layer (17).

Comparative Example 2 exhibited a large amount of displacement, since the twist pitch of the central core strand (5) exceeded 70 times the distance between diametrically opposed outer wires of the central core strand (5).

Comparative Example 3 exhibited a large amount of displacement, since the twist pitch of the first concentric strand layer (11) exceeded 30 times the distance between diametrically opposed strands of the first concentric strand layer (11).

Comparative Example 4 exhibited a large amount of displacement, since the twist pitch of the first concentric strand layer (11) exceeded 30 times the distance between diametrically opposed strands of the first concentric strand layer (11) and the twist pitch of the second concentric strand exceeded 30 times the distance between diametrically opposed strands of the second concentric strand.

In Comparative Example 5, concentric stranding was impossible, since $|\alpha-(\delta+\epsilon)|$ exceeded 15 degrees, where $\alpha$ is the twist angle of the central core strand (5), $\delta$ is the twist angle of the second-layer strands (15) and $\epsilon$ is the twist angle of the second concentric strand layer (17).

In Comparative Example 6, concentric stranding was impossible, since $|\alpha-(\beta+\gamma)|$ exceeded 15 degrees, where $\alpha$ is the twist angle of the central core strand (5), $\beta$ is the twist angle of the first-layer strands (9) and $\gamma$ is the twist angle of the first concentric strand layer (11).

Comparative Example 7 exhibited a large amount of displacement, since the elongation of the strands was less than 2% and $|\alpha-(\delta+\epsilon)|$ exceeded 15 degrees, where $\alpha$ is the twist angle of the central core strand (5), δ is the twist angle of the second-layer strands (15) and ϵ is the twist angle of the second concentric strand layer (17).

Comparative Example 8 exhibited a large amount of displacement, since $|\alpha-(\beta+\gamma)|$ exceeded 15 degrees, where α is the twist angle of the central core strand (5), β is the twist angle of the first-layer strands (9) and γ is the twist angle of the first concentric strand layer (11).

Comparative Example 9 exhibited a large amount of displacement, since $|\alpha-(\beta+\gamma)|$ exceeded 15 degrees, where α is the twist angle of the central core strand (5), β is the twist angle of the first-layer strands (9) and γ is the twist angle of the first concentric strand layer (11).

Comparative Example 10 exhibited a large amount of displacement, since $|\alpha-(\delta+\epsilon)|$ exceeded 15 degrees, where α is the twist angle of the central core strand (5), δ is the twist angle of the second-layer strands (15) and ϵ is the twist angle of the second concentric strand layer (17).

Comparative Example 11 exhibited a large amount of displacement, since $|\alpha-(\delta+\epsilon)|$ exceeded 15 degrees, where α is the twist angle of the central core strand (5), δ is the twist angle of the second-layer strands (15) and ϵ is the twist angle of the second concentric strand layer (17), and since $|(\beta+\gamma)-(\delta+\epsilon)|$ exceeded 15 degrees, where β is the twist angle of the first-layer strands (9), γ is the twist angle of the first concentric strand layer (11), δ is the twist angle of the second-layer strands (15) and ϵ is the twist angle of the second concentric strand layer (17).

Comparative Example 12 exhibited a large amount of displacement, since the elongation of the single wires was less than 2%.

Comparative Example 13 exhibited a large amount of displacement, since the elongation of the single wires was less than 2%.

In Comparative Example 14, concentric stranding was impossible, since the twist pitch of the central core strand (5) was less than 8 times the distance between diametrically opposed outer wires of the central core strand (5).

Comparative Example 15 exhibited a large amount of displacement, since the twist pitch of the first concentric strand layer (11) was less than 8 times the distance between diametrically opposed strands of the first concentric strand layer (11).

Comparative Example 16 exhibited a large amount of displacement, since the twist pitch of the second concentric strand was less than 8 times the distance between diametrically opposed strands of the second concentric strand, and since $|\alpha-(\delta+\epsilon)|$ exceeded 15 degrees, where α is the twist angle of the central core strand (5), δ is the twist angle of the second-layer strands (15) and ϵ is the twist angle of the second concentric strand layer (17).

Comparative Example 17 exhibited a large amount of displacement, since the twist pitch of the second concentric strand exceeded 30 times the distance between diametrically opposed strands of the second concentric strand.

In Comparative Example 18, concentric stranding was impossible, since the twist pitch of the central core strand (5) exceeded 70 times the distance between diametrically opposed outer wires of the central core strand (5).

In Comparative Example 19, concentric stranding was impossible, since the twist pitch of the central core strand (5) was less than 8 times the distance between diametrically opposed outer wires of the central core strand (5).

Comparative Example 20 exhibited a large amount of displacement, since the twist pitch of the first concentric strand layer (11) was less than 8 times the distance between diametrically opposed strands of the first concentric strand layer (11).

In Comparative Example 21, concentric stranding was impossible, since the twist pitch of the first concentric strand layer (11) exceeded 30 times the distance between diametrically opposed strands of the twist pitch of the first concentric strand layer (11).

Comparative Example 22 exhibited a large amount of displacement, since $|\alpha-(\beta+\gamma)|$ exceeded 15 degrees, where α is the twist angle of the central core strand (5), β is the twist angle of the first-layer strands (9) and γ is the twist angle of the first concentric strand layer (11).

INDUSTRIAL APPLICABILITY

The invention provides a concentric stranded conductor excellent in flexibility that is suitable for use as a concentric stranded conductor for electrical transmission in automobiles and the like.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority on Patent Application No. 2004-312575 filed in Japan on Oct. 27, 2004, and Patent Application No. 2005-288978 filed in Japan on Sep. 30, 2005, each of which is entirely herein incorporated by reference.

The invention claimed is:

1. A concentric stranded conductor having a concentric strand comprising a plurality of strands twisted together, in which each of the strands comprises a plurality of single wires twisted together;

wherein the concentric stranded conductor has a central core strand and a first concentric strand layer which comprises a plurality of first-layer strands twisted together around the central core strand;

wherein a twist pitch of the central core strand is from 8 to 70 times of a distance between diametrically opposed outer wires of the central core strand, a twist pitch of the first-layer concentric strand is from 8 to 30 times of a distance between diametrically opposed strands of the first-layer concentric strand, $|\alpha-(\beta+\gamma)|$ is 15 degrees or less, where α is a twist angle of the central core strand, β is a twist angle of the first-layer strands and γ is a twist angle of the first concentric strand layer, and each of the single wires is made of aluminum or an aluminum alloy, each having elongation of 2% or more.

2. The concentric stranded conductor according to claim 1, wherein the central core strand, the first-layer strands, and the first concentric strand layer are all twisted in the same direction.

3. A concentric stranded conductor as claimed in claim 1 or 2, further comprising a second concentric strand layer comprising a plurality of second-layer strands twisted around the concentric stranded conductor, wherein $|\alpha-(\delta+\epsilon)|$ is 15 degrees or less, where α is the twist angle of the central core strand, δ is a twist angle of the second-layer strands and ϵ is a twist angle of the second concentric strand layer, and wherein $|(\beta+\gamma)-(\delta+\epsilon)|$ is 15 degrees or less, where β is the twist angle of the first-layer strands, γ is the twist angle of the first concentric strand layer, δ is the twist angle of the second-layer strands and ϵ is the twist angle of the second concentric strand layer, and a twist pitch of the second concentric strand layer is from 8 to 30 times of a distance between diametrically opposed strands of the second concentric strand layer.

4. The concentric stranded conductor according to claim 3, wherein the central core strand, the first-layer strands, the first concentric strand layer, the second-layer strands, and the second concentric strand layer are all twisted in the same direction.

* * * * *